US008928233B1

(12) United States Patent
Peng

(10) Patent No.: US 8,928,233 B1
(45) Date of Patent: Jan. 6, 2015

(54) LIGHT EMITTING DIODE CONTROL CIRCUIT WITH CARRIER SIGNAL CONTROL AND PACKAGE STRUCTURE FOR THE SAME AND SYSTEM FOR THE SAME

(71) Applicant: Semisilicon Technology Corp., New Taipei (TW)

(72) Inventor: Wen-Chi Peng, New Taipei (TW)

(73) Assignee: Semisilicon Technology Corp., New Taipei (TW)

( * ) Notice: Subject to any disclaimer, the term of this patent is extended or adjusted under 35 U.S.C. 154(b) by 0 days.

(21) Appl. No.: 14/079,574

(22) Filed: Nov. 13, 2013

(51) Int. Cl.
*H05B 37/00* (2006.01)

(52) U.S. Cl.
USPC ..... 315/192; 315/185 S; 315/209 R; 315/312; 315/291

(58) Field of Classification Search
USPC ..... 315/192, 184, 209 R, 224, 225, 246, 315/250, 291, 307, 312–326, 185 S
See application file for complete search history.

(56) References Cited

U.S. PATENT DOCUMENTS 8,134,299 B2 * 3/2012 Peng ..... 315/192
2010/0013396 A1 * 1/2010 Peng ..... 315/192

* cited by examiner

*Primary Examiner* — Tuyet Thi Vo
(74) *Attorney, Agent, or Firm* — Muncy, Geissler, Olds & Lowe, P.C.

(57) ABSTRACT

A light emitting diode control circuit with carrier signal control includes a signal coupling unit, an operational amplifier, a demodulation unit, an identification and control logic unit, a counting and shift-registering unit, a data register, an output register, at least a current output unit, an address encoding unit, an address register, a voltage regulator and an oscillator. The efficiency of the present invention is to reduce the transmission lines of the light emitting diode lamp. Therefore, the cost of the light emitting diode lamp is reducing.

10 Claims, 5 Drawing Sheets

LIGHT EMITTING DIODE CONTROL CIRCUIT WITH CARRIER SIGNAL CONTROL AND PACKAGE STRUCTURE FOR THE SAME AND SYSTEM FOR THE SAME

BACKGROUND OF THE INVENTION

1. Field of the Invention

The present invention relates to a light emitting diode control circuit and package structure for the same and system for the same, and especially relates to a light emitting diode control circuit with carrier signal control and package structure for the same and system for the same.

2. Description of the Related Art

Nowadays, the connection types of the light emitting diode lamp string modules are separated into two types: the serial-type connection and the parallel-type connection. The light emitting diode lamp string modules are widely used for external walls of the building, decoration of trees, signboards, and scenery designing.

The related art light emitting diode lamp string modules are commonly employed to be connected in series. Also, the amount of the light emitting diode lamp string modules is determined according to the volume of the decorated objects. In addition, all of the light emitting diode lamp string modules are controlled by the same controller which initially controls the first light emitting diode lamp string module.

Although the light emitting diode lamp string modules are easily connected together, the remaining light emitting diode lamp string modules behind the abnormal light emitting diode lamp string module cannot be lighted even only one of the light emitting diode lamp string modules is abnormal. That is because the control signal cannot be sent to drive all of the remaining light emitting diode lamp string modules.

The parallel-type light emitting diode lamp string modules are connected to the controller in parallel. Accordingly, each one of the light emitting diode lamp string modules is controlled by the controller through a control line and an address line, respectively. For example, ten control lines and ten address lines need to be used when ten light emitting diode lamp string modules are employed to be connected in parallel.

The remaining light emitting diode lamp string modules can still be normally controlled when one of the light emitting diode lamp string modules is abnormal. However, the amount of the control lines and the address lines increase proportionally. Therefore, complexity and the costs of the equipment also increase when the amount of the light emitting diode lamp string modules increases.

No matter the connection type of the light emitting diode lamp string modules is the serial-type or the parallel-type, many power transmission lines and signal transmission lines need to be used to control the colors and intensities of the light emitting diode lamp string modules. Accordingly, cost down can be achieved only if the amount of the power transmission lines or the signal transmission lines can be reduced.

SUMMARY OF THE INVENTION

In order to solve the above-mentioned problems, an object of the present invention is to provide a light emitting diode control circuit with carrier signal control.

In order to solve the above-mentioned problems, another object of the present invention is to provide a light emitting diode package structure with carrier signal control.

In order to solve the above-mentioned problems, still another object of the present invention is to provide a light emitting diode system with carrier signal control.

In order to solve the above-mentioned problems, still another object of the present invention is to provide a light emitting diode system with carrier signal control.

In order to achieve the object of the present invention mentioned above, the light emitting diode control circuit is applied to a power positive terminal, a power negative terminal and at least a light emitting diode. The light emitting diode control circuit includes a signal coupling unit, an operational amplifier, a demodulation unit, an identification and control logic unit, a counting and shift-registering unit, a data register, an output register, at least a current output unit, an address encoding unit and an address register. The signal coupling unit is electrically connected to the power positive terminal. The operational amplifier is electrically connected to the signal coupling unit and the power negative terminal. The demodulation unit is electrically connected to the operational amplifier and the power negative terminal. The identification and control logic unit is electrically connected to the demodulation unit and the power negative terminal. The counting and shift-registering unit is electrically connected to the identification and control logic unit and the power negative terminal. The data register is electrically connected to the counting and shift-registering unit and the power negative terminal. The output register is electrically connected to the data register and the power negative terminal. The current output unit is electrically connected to the output register and the light emitting diode. The address encoding unit is electrically connected to the identification and control logic unit. The address register is electrically connected to the identification and control logic unit and the address encoding unit.

In order to achieve other object of the present invention mentioned above, the light emitting diode package structure includes the light emitting diode control circuit mentioned above. The light emitting diode package structure further includes a first support, a first platform, a second support, a second platform, the light emitting diode and a package. The first platform is arranged at one side of the first support. The second support is arranged parallel to the first support. The second platform is arranged at one side of the second support. The light emitting diode control circuit is arranged on the second platform and is electrically connected to the second platform. The light emitting diode is arranged on the first platform and is electrically connected to the first platform. The light emitting diode control circuit is electrically connected to the light emitting diode. The package covers the first platform, the second platform, the light emitting diode control circuit and the light emitting diode.

In order to achieve other object of the present invention mentioned above, the light emitting diode system is applied to an alternating current power apparatus. The light emitting diode system includes a plurality of the light emitting diode package structures mentioned above. The light emitting diode system further includes a main control unit, a carrier generating unit and a transmission line. The main control unit is electrically connected to the light emitting diode package structure. The carrier generating unit is electrically connected to the main control unit. The transmission line is electrically connected to the light emitting diode package structures in series.

In order to achieve other object of the present invention mentioned above, the light emitting diode system includes a plurality of the light emitting diode package structures mentioned above. The light emitting diode system further includes a main control unit, a carrier generating unit and a transmission line. The main control unit is electrically connected to the light emitting diode package structures. The carrier generating unit is electrically connected to the main control unit. The transmission line is electrically connected to the light emitting diode package structures in parallel.

The efficiency of the present invention is to reduce the transmission lines of the light emitting diode lamp. Therefore, the cost of the light emitting diode lamp is reducing.

DETAILED DESCRIPTION OF THE INVENTION

Figure 1:
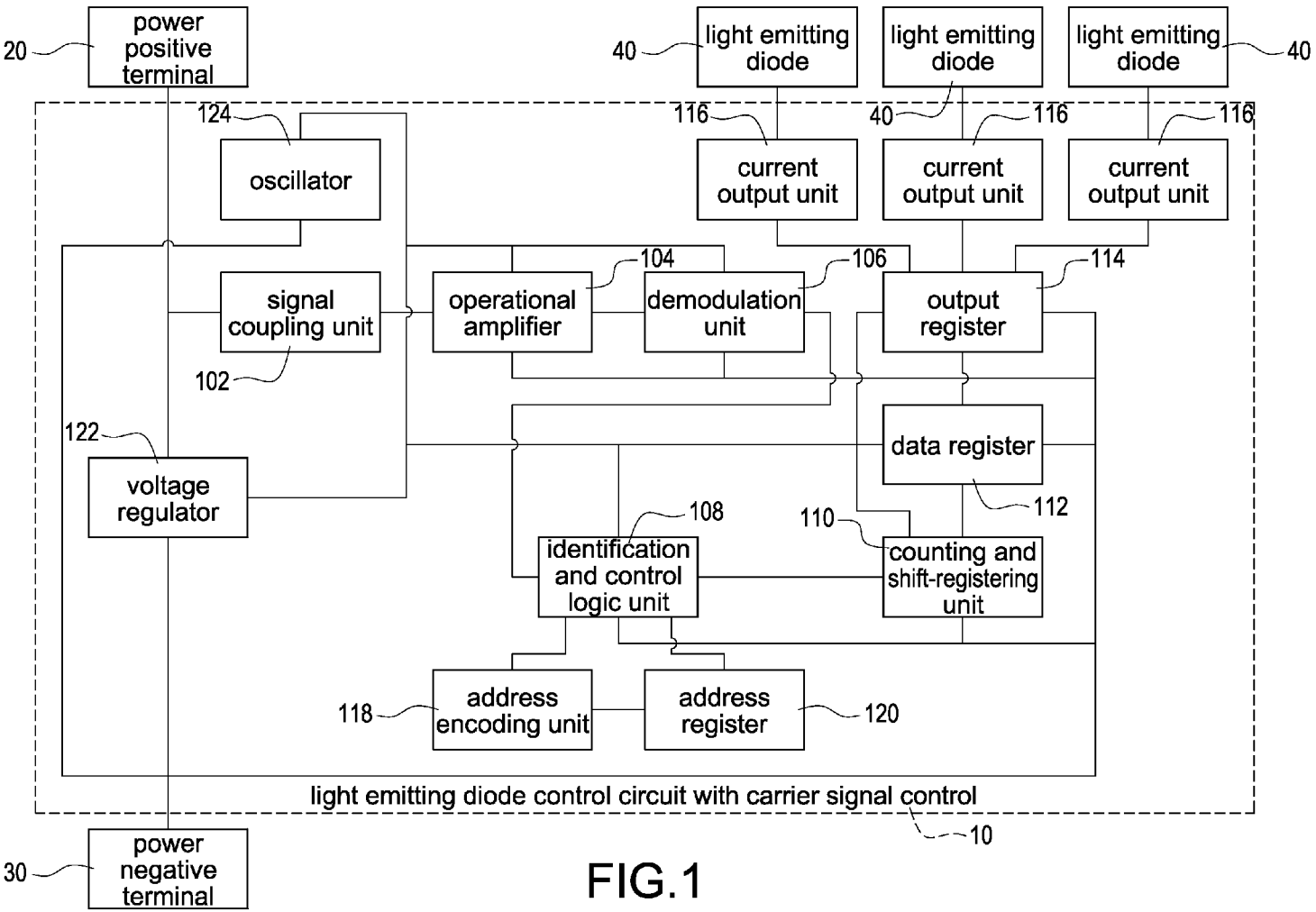
FIG. 1 shows a block diagram of the light emitting diode control circuit of the present invention.

FIG. 1 shows a block diagram of the light emitting diode control circuit of the present invention. A light emitting diode control circuit 10 with carrier signal control is applied to a power positive terminal 20, a power negative terminal 30 and at least a light emitting diode 40.

The light emitting diode control circuit 10 includes a signal coupling unit 102, an operational amplifier 104, a demodulation unit 106, an identification and control logic unit 108, a counting and shift-registering unit 110, a data register 112, an output register 114, at least a current output unit 116, an address encoding unit 118, an address register 120, a voltage regulator 122 and an oscillator 124.

The signal coupling unit 102 is electrically connected to the power positive terminal 20. The operational amplifier 104 is electrically connected to the signal coupling unit 102 and the power negative terminal 30. The demodulation unit 106 is electrically connected to the operational amplifier 104 and the power negative terminal 30. The identification and control logic unit 108 is electrically connected to the demodulation unit 106 and the power negative terminal 30. The counting and shift-registering unit 110 is electrically connected to the identification and control logic unit 108 and the power negative terminal 30. The data register 112 is electrically connected to the counting and shift-registering unit 110 and the power negative terminal 30. The output register 114 is electrically connected to the data register 112 and the power negative terminal 30. The current output unit 116 is electrically connected to the output register 114 and the light emitting diode 40. The address encoding unit 118 is electrically connected to the identification and control logic unit 108. The address register 120 is electrically connected to the identification and control logic unit 108 and the address encoding unit 118. The voltage regulator 122 is electrically connected to the power positive terminal 20, the power negative terminal 30, the operational amplifier 104, the demodulation unit 106, the identification and control logic unit 108, the counting and shift-registering unit 110, the data register 112 and the output register 114. The oscillator 124 is electrically connected to the voltage regulator 122 and the power negative terminal 30.

The signal coupling unit 102 is used for coupling signals. The demodulation unit 106 is used for demodulating signals. The identification and control logic unit 108 is used for identifying signals and logic processing and controlling signals. The counting and shift-registering unit 110 is used for counting and shift registering data. The data register 112 is used for registering data. The output register 114 is used for registering data and outputting data. The address encoding unit 118 is used for encoding address data. The address register 120 is used for registering address data.

According to the components mentioned above, the light emitting diode control circuit 10 is configured to extract a light signal from a direct current power to control the light emitting diode 40 lighting, wherein the direct current power is sent from the power positive terminal 20 and includes the light signal.

Moreover, a related art modulates the light signal with a high frequency, and then the modulated light signal is sent with power. However, the present invention does not modulate the light signal with the high frequency. The present invention raises the frequency of the light signal directly, and then the light signal is sent with power. Therefore, no filter circuit is required for the light emitting diode control circuit 10. Moreover, the light signal sent to next light emitting diode control circuit 10 is not required to modulate because the light emitting diode control circuit 10 includes the address encoding unit 118. Therefore, a second modulation circuit is saved. Moreover, the current output unit 116 is, for example, a constant current source.

Figure 2:
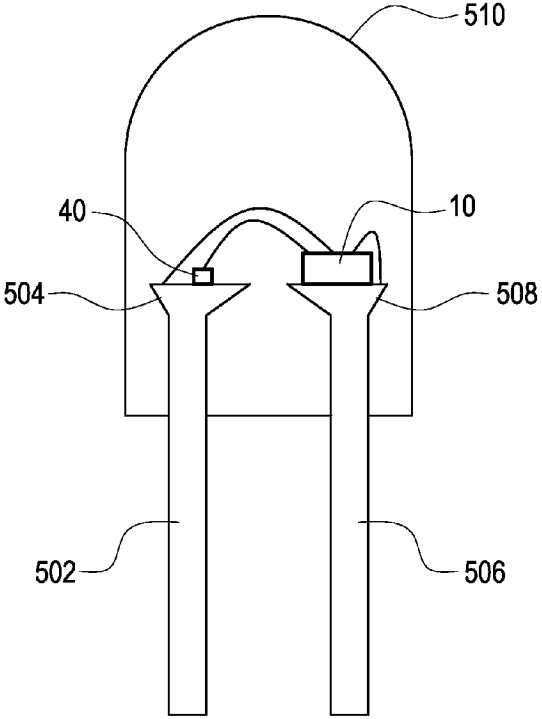
FIG. 2 shows a perspective view of the light emitting diode package structure of the present invention.

FIG. 2 shows a perspective view of the light emitting diode package structure of the present invention. A light emitting diode package structure 50 with carrier signal control includes the light emitting diode control circuit 10 mentioned above.

The light emitting diode package structure 50 further includes a first support 502, a first platform 504, a second support 506, a second platform 508, the light emitting diode 40 and a package 510.

The first platform 504 is arranged at one side of the first support 502. The second support 506 is arranged parallel to the first support 502. The second platform 508 is arranged at one side of the second support 506. The light emitting diode control circuit 10 is arranged on the second platform 508 and is electrically connected to the second platform 508. The light emitting diode 40 is arranged on the first platform 504 and is electrically connected to the first platform 504. The light emitting diode control circuit 10 is electrically connected to the light emitting diode 40. The package 510 covers the first platform 504, the second platform 508, the light emitting diode control circuit 10 and the light emitting diode 40.

Figure 3:
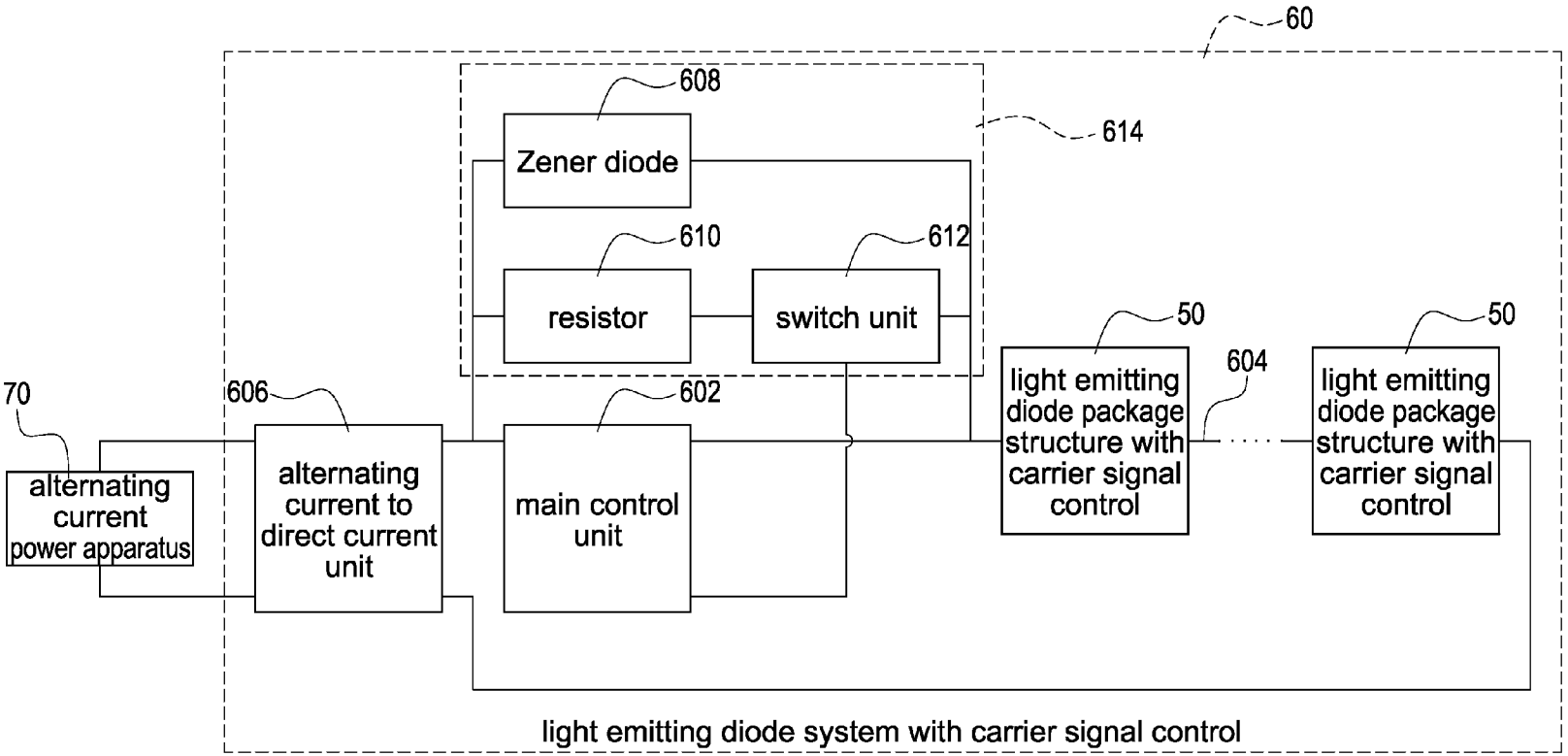
FIG. 3 shows a block diagram of an embodiment of the light emitting diode system of the present invention.

FIG. 3 shows a block diagram of an embodiment of the light emitting diode system of the present invention. A light emitting diode system 60 with carrier signal control is applied to an alternating current power apparatus 70.

The light emitting diode system 60 includes a plurality of the light emitting diode package structures 50 mentioned above. The light emitting diode system 60 further includes a main control unit 602, a carrier generating unit 614, a transmission line 604 and an alternating current to direct current unit 606. The carrier generating unit 614 includes a Zener diode 608, a resistor 610 and a switch unit 612.

The main control unit 602 is electrically connected to the light emitting diode package structure 50. The carrier generating unit 614 is electrically connected to the main control unit 602. One side of the carrier generating unit 614 is electrically connected to the alternating current to direct current unit 606 and the main control unit 602. The other side of the carrier generating unit 614 is electrically connected to the main control unit 602 and the light emitting diode package structure 50. The transmission line 604 is electrically connected to the light emitting diode package structures 50 in series. The alternating current to direct current unit 606 is electrically connected to the alternating current power apparatus 70, the main control unit 602 and the light emitting diode package structure 50. The Zener diode 608 is electrically connected to the main control unit 602, the alternating current to direct current unit 606 and the light emitting diode package structure 50. The resistor 610 is electrically connected to the main control unit 602, the alternating current to direct current unit 606 and the Zener diode 608. The switch unit 612 is electrically connected to the resistor 610, the Zener diode 608, the main control unit 602 and the light emitting diode package structure 50.

The main control unit 602 transmits the direct current power which includes the light signal through the transmission line 604.

Figure 4:
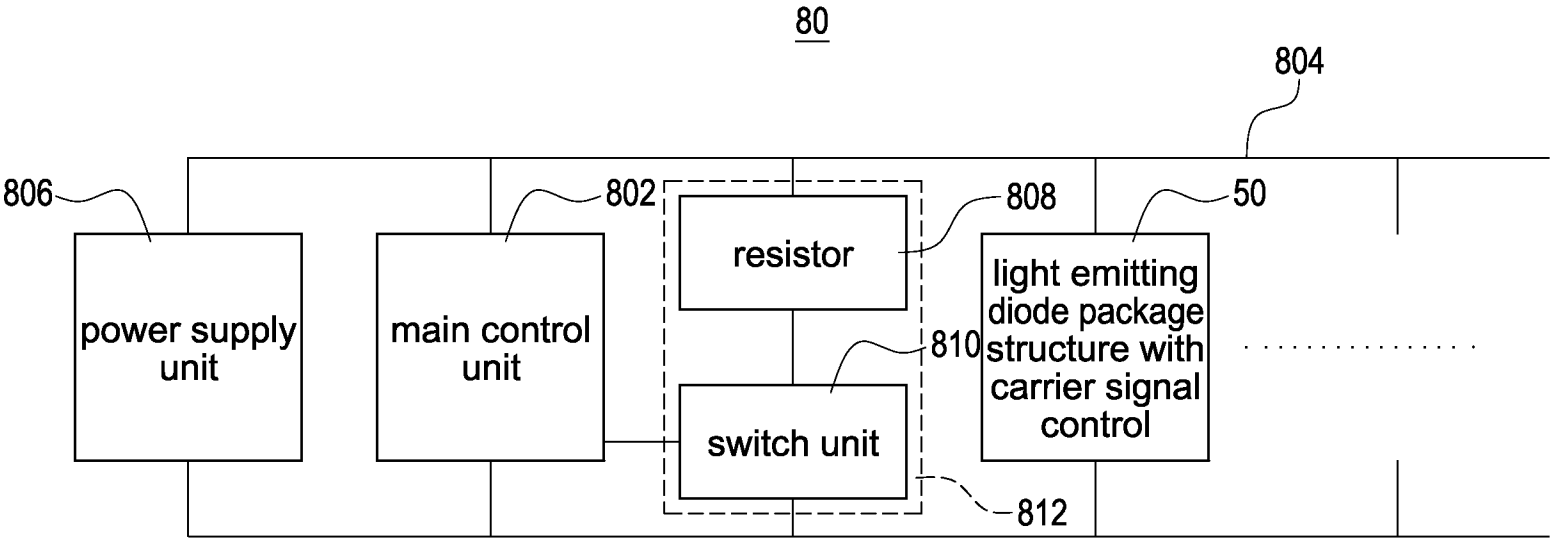
FIG. 4 shows a block diagram of another embodiment of the light emitting diode system of the present invention.

FIG. 4 shows a block diagram of another embodiment of the light emitting diode system of the present invention. A light emitting diode system 80 with carrier signal control includes a plurality of the light emitting diode package structures 50 mentioned above.

The light emitting diode system 80 further includes a main control unit 802, a carrier generating unit 812, a transmission line 804 and a power supply unit 806. The carrier generating unit 812 includes a resistor 808 and a switch unit 810.

The main control unit 802 is electrically connected to the light emitting diode package structures 50. The transmission line 804 is electrically connected to the light emitting diode package structures 50 in parallel. The power supply unit 806 is electrically connected to the main control unit 802, the transmission line 804 and the light emitting diode package structures 50. The resistor 808 is electrically connected to the main control unit 802, the transmission line 804, the light emitting diode package structures 50 and the power supply unit 806. The switch unit 810 is electrically connected to the resistor 808, the main control unit 802, the light emitting diode package structures 50 and the power supply unit 806.

The main control unit 802 transmits the direct current power which includes the light signal through the transmission line 804.

Figure 5:
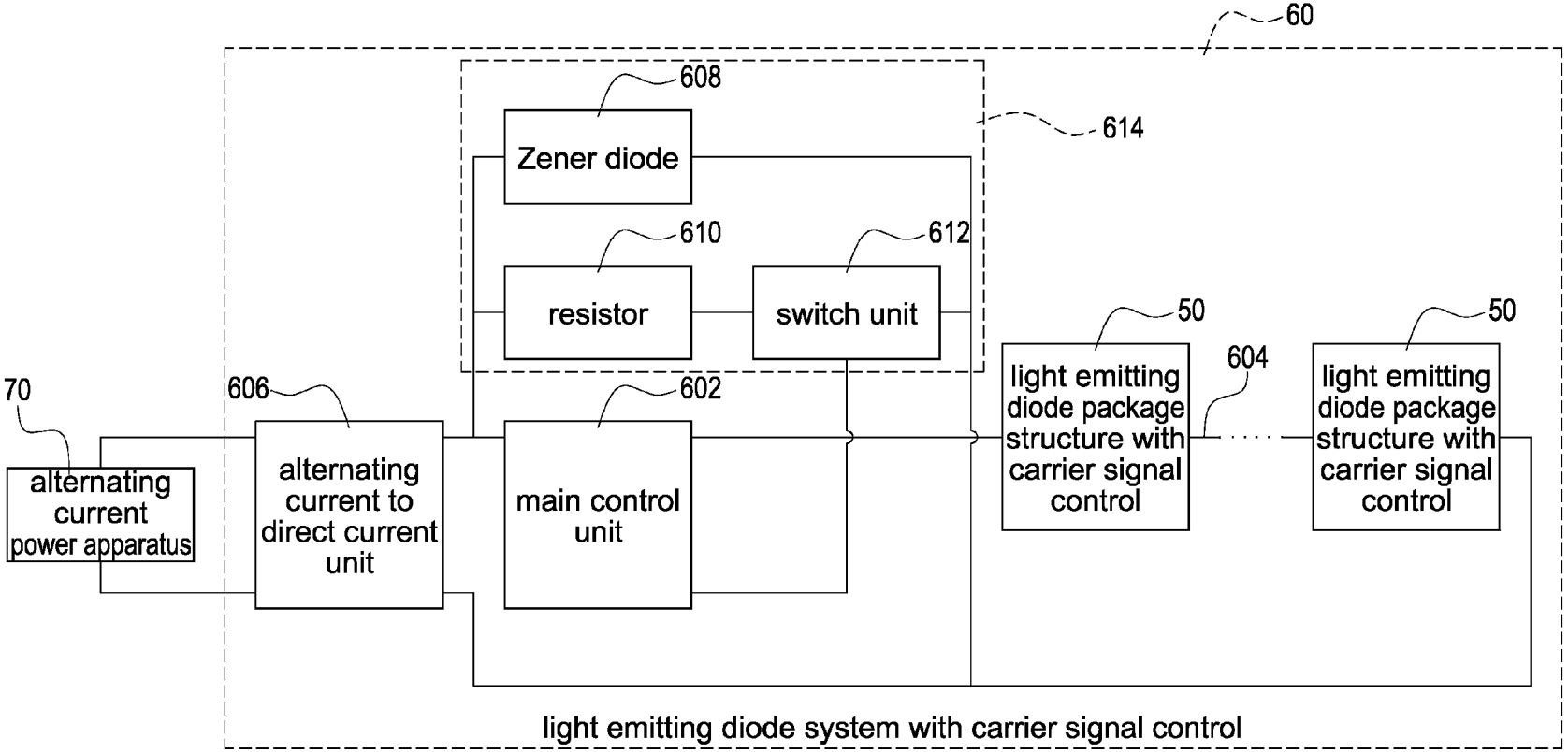
FIG. 5 shows a block diagram of still another embodiment of the light emitting diode system of the present invention.

FIG. 5 shows a block diagram of still another embodiment of the light emitting diode system of the present invention. The contents in FIG. 5 are similar to the contents in FIG. 3. The differences are that one side of the carrier generating unit 614 is electrically connected to the alternating current to direct current unit 606 and the main control unit 602. The other side of the carrier generating unit 614 is electrically connected to a power negative terminal of the alternating current to direct current unit 606.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A light emitting diode control circuit with carrier signal control, the light emitting diode control circuit applied to a power positive terminal, a power negative terminal and at least a light emitting diode, the light emitting diode control circuit comprising:

a signal coupling unit electrically connected to the power positive terminal;

an operational amplifier electrically connected to the signal coupling unit and the power negative terminal;

a demodulation unit electrically connected to the operational amplifier and the power negative terminal;

an identification and control logic unit electrically connected to the demodulation unit and the power negative terminal;

a counting and shift-registering unit electrically connected to the identification and control logic unit and the power negative terminal;

a data register electrically connected to the counting and shift-registering unit and the power negative terminal;

an output register electrically connected to the data register and the power negative terminal;

at least a current output unit electrically connected to the output register and the light emitting diode;

an address encoding unit electrically connected to the identification and control logic unit; and an address register electrically connected to the identification and control logic unit and the address encoding unit.

2. The light emitting diode control circuit in claim 1, further comprising:

a voltage regulator electrically connected to the power positive terminal, the power negative terminal, the operational amplifier, the demodulation unit, the identification and control logic unit, the counting and shift-registering unit, the data register and the output register.

3. The light emitting diode control circuit in claim 2, further comprising:

an oscillator electrically connected to the voltage regulator and the power negative terminal, wherein the current output unit is a constant current source.

4. A light emitting diode package structure with carrier signal control, the light emitting diode package structure comprising the light emitting diode control circuit in claim 3, the light emitting diode package structure further comprising:

a first support;

a first platform arranged at one side of the first support;

a second support arranged parallel to the first support;

a second platform arranged at one side of the second support, the light emitting diode control circuit arranged on the second platform and electrically connected to the second platform;

the light emitting diode arranged on the first platform and electrically connected to the first platform, the light emitting diode control circuit electrically connected to the light emitting diode; and a package covering the first platform, the second platform, the light emitting diode control circuit and the light emitting diode.

5. A light emitting diode system with carrier signal control, the light emitting diode system applied to an alternating current power apparatus, the light emitting diode system comprising a plurality of the light emitting diode package structures in claim 4, the light emitting diode system further comprising:

a main control unit electrically connected to the light emitting diode package structure;

a carrier generating unit electrically connected to the main control unit; and a transmission line electrically connected to the light emitting diode package structures in series.

6. The light emitting diode system in claim 5, further comprising:

an alternating current to direct current unit electrically connected to the alternating current power apparatus, the main control unit and the light emitting diode package structure.

7. The light emitting diode system in claim 6, wherein the carrier generating unit comprises:

a Zener diode electrically connected to the main control unit, the alternating current to direct current unit and the light emitting diode package structure;

a resistor electrically connected to the main control unit, the alternating current to direct current unit and the Zener diode; and a switch unit electrically connected to the resistor, the Zener diode, the main control unit and the light emitting diode package structure.

8. A light emitting diode system with carrier signal control, the light emitting diode system comprising a plurality of the light emitting diode package structures in claim 4, the light emitting diode system further comprising:

a main control unit electrically connected to the light emitting diode package structures;

a carrier generating unit electrically connected to the main control unit; and a transmission line electrically connected to the light emitting diode package structures in parallel.

9. The light emitting diode system in claim 8, further comprising:

a power supply unit electrically connected to the main control unit, the transmission line and the light emitting diode package structures.

10. The light emitting diode system in claim 9, wherein the carrier generating unit comprises:

a resistor electrically connected to the main control unit, the transmission line, the light emitting diode package structures and the power supply unit; and a switch unit electrically connected to the resistor, the main control unit, the light emitting diode package structures and the power supply unit.

* * * * *